US007350253B2

(12) United States Patent
Simon

(10) Patent No.: US 7,350,253 B2
(45) Date of Patent: Apr. 1, 2008

(54) INFANT SLEEP SUPPORT DEVICE SIMULATING BURPING POSITION

(76) Inventor: Geula Simon, 2127 W. Gardenia, Phoenix, AZ (US) 85021

( * ) Notice: Subject to any disclaimer, the term of this patent is extended or adjusted under 35 U.S.C. 154(b) by 0 days.

(21) Appl. No.: 11/371,874

(22) Filed: Mar. 7, 2006

(65) Prior Publication Data

US 2007/0209116 A1 Sep. 13, 2007

(51) Int. Cl.
*A47D 9/00* (2006.01)

(52) U.S. Cl. ..... 5/655; 5/93.2; 5/101; 5/105; 297/260.1

(58) Field of Classification Search ..... 5/93.2, 5/101, 102, 105–107, 655; 297/260.1, 273, 297/281

See application file for complete search history.

(56) References Cited

U.S. PATENT DOCUMENTS 3,545,016 A * 12/1970 Schorken ..... 4/659
4,359,045 A * 11/1982 Cozzi ..... 601/5
4,802,244 A 2/1989 McGrath-Saleh
5,423,099 A 6/1995 Gulli
5,440,770 A * 8/1995 Nichols ..... 5/655
5,561,876 A 10/1996 Petruzella
5,581,832 A 12/1996 Bridley
5,746,219 A 5/1998 McConnell
6,023,802 A 2/2000 King
6,823,547 B1 11/2004 Harding
6,898,812 B2 * 5/2005 Smart ..... 5/655
6,931,683 B1 * 8/2005 Elkin et al. ..... 5/655
7,107,639 B2 * 9/2006 Taricani ..... 5/655

* cited by examiner

*Primary Examiner*—Michael Trettel
(74) *Attorney, Agent, or Firm*—Cahill, von Hellens & Glazer, P.L.C.

(57) ABSTRACT

An infant sleep support device includes a semi-rigid curved support having head support, stomach support, and leg support surfaces covered by a padded cushion that simulates a mother's anatomy. Panties having elasticized waist and leg openings are secured to the curved support by straps, and are extended over the infant to secure the infant to the curved support. Shoulder straps may also extend over the infant's shoulders. The curved support is maintained by a frame member in an orientation that positions the head support surface horizontally. The frame member may suspend the curved support for rocking motion, and the curved support may be removably attached to such frame member.

18 Claims, 3 Drawing Sheets

INFANT SLEEP SUPPORT DEVICE SIMULATING BURPING POSITION

BACKGROUND OF THE INVENTION

1. Field of the Invention

The present invention relates generally to devices used to support infants, and more particularly, to an infant sleep support device that positions an infant upon his or her stomach.

2. Description of the Relevant Art

As many new parents will confirm, it can be a significant challenge to support a newborn infant in a sleeping position within a cradle, crib, infant carrier, bouncer, or other infant support device in a manner that the infant finds comfortable. Most newborn infants prefer to be held by the mother, father, or other caregiver (hereinafter referred to collectively as "the caregiver"), but it is often necessary for the caregiver to put the infant down to perform other tasks. While there are a wide variety of infant carriers, car seats, bouncers, jumpers, and wind-up swings available to new parents, putting the infant down into one of such infant support devices is often accompanied by waking, fussing and/or crying, resulting in unpleasantness for both the infant and the caregiver.

Most infant support devices that are available today support an infant upon his or her back, either in a horizontal, level position or in an inclined position. Such positioning may be advantageous when an infant is awake, alert and content with observing the surroundings. However, when an infant is sleepy and cranky, the infant often finds such positioning to be uncomfortable. Other infant support devices are known wherein an infant is supported face down upon a generally horizontal mattress or other padded surface. Once again, however, an infant that is sleepy and unhappy often refuses to fall asleep when placed in such position.

The result is that the caregiver often finds it necessary to pick up the infant and to support the infant over the caregiver's shoulder to quiet the infant down in a position similar to that used to burp an infant after feeding. Alternatively, mothers often sit in a chair and rest the infant's head face down upon the mother's chest, with the infant's legs draping over the mother's stomach. Infants apparently find such positions comforting and often calm down and fall asleep shortly thereafter. In some instances the mother or other caregiver finds it helpful to gently rock the baby to sleep in one of such positions.

Accordingly, it is an object of the present invention to provide an infant sleep support device that allows newborn infants, up to approximately three months old, to sleep in a more natural position upon their stomachs.

Another object of the present invention is to more closely simulate the position and feel of an infant in a burping position upon a caregiver's shoulder, with the infant's legs positioned lower than the infant's head.

Yet another object of the present invention is to more closely simulate the position and feel of an infant lying face down upon a mother's chest.

Still another object of the present invention is to provide such an infant sleep support device that supports the infant's head upon a generally horizontal surface while supporting the infant's lower abdomen and legs on a downwardly-inclined surface.

A further object of the present invention is to provide such an infant sleep support device that reliably, but comfortably, secures an infant therein.

A still further object of the present invention is to provide such an infant sleep support device that can alternately be rocked back and forth or supported in a fixed, non-rocking position.

A yet further object of the present invention is to provide such an infant sleep support device that may alternately be used to support an infant upon his or her back.

These and other objects of the present invention will become more apparent to those skilled in the art as the description of the present invention proceeds.

SUMMARY OF THE INVENTION

Briefly described, and in accordance with a preferred embodiment thereof, the present invention relates to an infant support device for supporting an infant in a position that simulates the position in which an infant is supported over a mother's shoulder when being burped or rocked to sleep. The infant support device includes a semi-rigid curved support that includes a head support surface for supporting the head of the infant in a generally horizontal plane, as well as a stomach support surface coupled to the head support surface for supporting the stomach of the infant. The stomach support surface extends at a slightly downward incline from the head support surface. In the preferred embodiment, the curved support further includes a leg support surface coupled to the stomach support surface and extending at a downward incline therefrom to help support the infant's legs.

The infant support device of the present invention also includes a padded cushion disposed over the head support surface and over the stomach support surface; this cushion also preferably extends over the leg support surface of the curved support. In a preferred embodiment, the region of the cushion that covers the stomach support surface includes first and second spaced cushioned mounds to simulate a mother's breasts.

The infant support device of the present invention further includes a fastening system for securing the infant upon the curved support. This fastening system is fastened to the curved support, and extending generally about the infant's waist to secure the infant upon the curved support. Preferably, the fastening system includes a pair of panties which are engaged about the infant's waist and legs while placing the infant upon the infant support device. One or more straps may be used to secure the panties (and the infant) down against the curved support. In the preferred embodiment, the waist band and leg openings of the panties are elasticized to snugly engage the infant's waist and legs. Preferably, the fastening system also includes first and second shoulder straps that extend from the panties over the shoulders of the infant and back to the curved support.

The infant support device preferably includes a frame member adapted to rest upon a table or other horizontal base. The frame member is coupled to the curved support for supporting the curved support in a position wherein the cushioned head support surface extends generally horizontally. In one preferred form, the curved support is movingly supported by the frame member for allowing the curved support, and the infant supported thereupon, to be rocked back and forth. It is preferred that the curved support is removably attached to the frame member for allowing transport of the infant support device without the need to carry the frame member. Alternatively, or in addition to the rocking frame member just described, a support leg may be pivotally coupled to, and selectively extended from, the underside of the curved support for propping the infant support device into an upright position.

DETAILED DESCRIPTION OF THE PREFERRED EMBODIMENT

Figure 1:
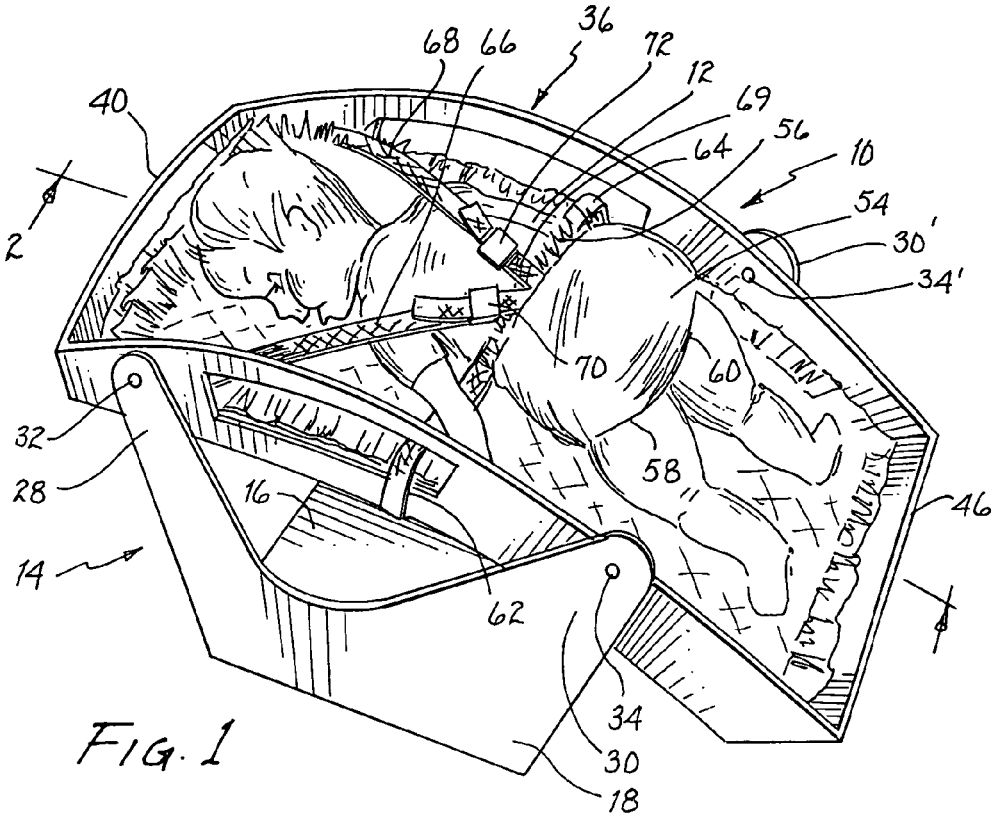
FIG. 1 is a perspective view of an infant support device constructed in accordance with a preferred embodiment of the present invention.

Referring to FIG. 1, an infant support device corresponding to a preferred embodiment of the present invention is designated generally by reference numeral 10. Infant 12 is positioned face down upon infant support device 10 in a position that simulates the position of an infant being supported over a mother's shoulder while burping the infant.

Figure 2:
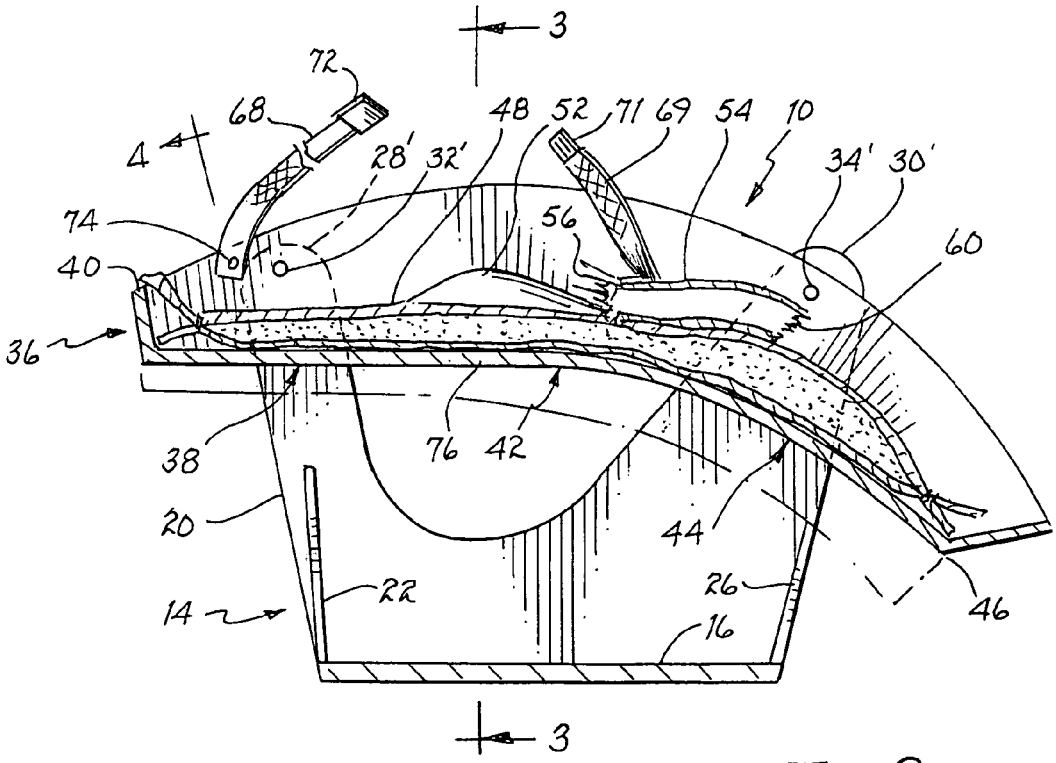
FIG. 2 is a side, cross-sectional view of the infant support device shown in FIG. 1 taken through section lines 2-2 as shown in FIG. 1.
Figure 3:
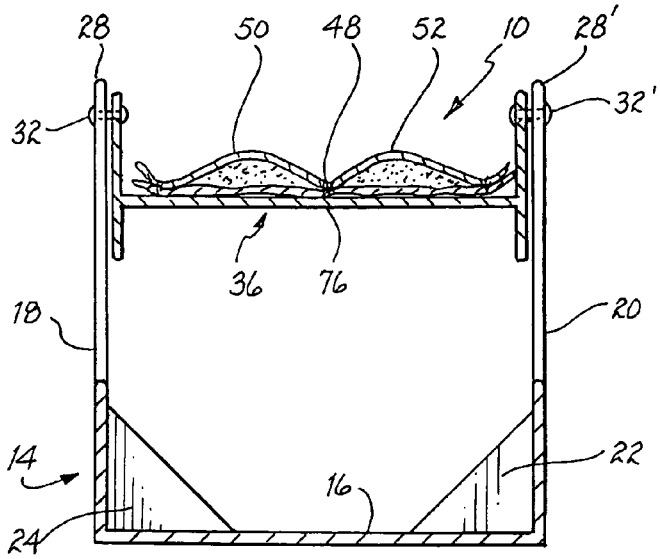
FIG. 3 is a sectional view of the infant support device shown in FIG. 2 sectioned through section lines 3-3 as indicated in FIG. 2.

A base or frame member 14 can be used to support infant support device 10 upon a table, horizontal base, or other generally horizontal support surface. In the preferred embodiment, base 14 includes a bottom wall 16 and a first vertical side wall 18. First vertical side wall 18 has its lower edge connected to a first side edge of bottom wall 16. First vertical side wall 18 extends upwardly toward two spaced-apart peaks 28 and 30. Referring to FIGS. 2 and 3, base 14 also includes a second vertical side wall 20 opposite first vertical side wall 18 and having the same shape as first vertical side wall 18. Preferably, base 14 is made from plastic for strength, durability, and to minimize weight and cost.

In order to rigidify base 14, a first triangular angle brace 22 is preferably connected between bottom wall 16 and second vertical side wall 20; likewise, a second triangular angle brace 24 is preferably connected between bottom wall 16 and first vertical side wall 18. Angle brace 24 is preferably disposed generally below peak 28 adjacent a first end of bottom wall 16; angle brace 22 is preferably disposed opposite angle brace 24. Preferably, a second pair of such angle braces is provided proximate the opposite end of bottom wall 16; in FIG. 2, angle brace 26 is shown extending between bottom wall 16 and second vertical side wall 20 along a second end of bottom wall 16. A similar angle brace (not shown) is preferably connected between bottom wall 16 and first vertical side wall 18 opposite angle brace 26.

Referring to FIGS. 1 and 2, infant support device 10 includes a semi-rigid curved support designated generally by reference numeral 36. Curved support 36 is preferably molded from plastic, again for strength, durability, and to minimize weight and cost. Curved support 36 includes a head support surface 38 proximate the upper end 40 thereof for supporting the head of infant 12 in a generally horizontal plane. Curved support 36 also includes a stomach support surface 42 extending from, and hence, coupled to, head support surface 38 for supporting the stomach of infant 12. Stomach support surface 42 preferably extends at a slightly downward incline from head support surface 38. 2. In the preferred embodiment, curved support 36 further includes a leg support surface 44 extending at a downward incline from, and coupled to, stomach support surface 42 until reaching the lower end 46 of curved support 36.

Figure 5:
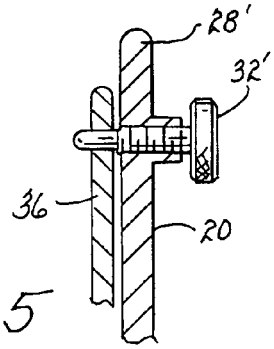
FIG. 5 is an enlarged sectional view showing one option for removably attaching the curved support of the infant support device to its underlying frame.

Base 14 is coupled to curved support 36 and is adapted to support and suspend curved support 36 in a position wherein head support surface 38 extends generally horizontally. In one embodiment, wherein curved support 36 is fixed, and not permitted to rock, a threaded fastener 32 extends through a threaded aperture formed in upper peak portion 28 of vertical side wall 18 and into a corresponding aperture formed in a side wall of curved support 36. A similar threaded fastener 34 is used to secure curved support 36 to peak portion 30 of base 14. Similar threaded fasteners 32' and 34' are used to secure the opposite side of curved support 36 to the upper peak portions 28' and 30' of vertical side wall 20. FIG. 5 is an enlarged sectional detailed view showing threaded fastener 32' threadedly engaged with a threaded aperture formed in vertical side wall 20 and extending into a corresponding aperture formed in a side wall of curved support 36. Such threaded fasteners are removable for allowing curved support 36 to be removed from base 14.

Since curved support 36 is semi-rigid, it is desirable that contact between infant 12 and curved support 36 be cushioned, particularly if the infant is to be positioned face down upon curved support 36. Accordingly, infant support device 10 includes a contoured cushion 48 disposed over at least head support surface 38 and over stomach support surface 42. Preferably cushion 48 further extends over leg support surface 44 of curved support 36. To further calm infant 12, the portion of cushion 48 that extends over stomach support surface 42 includes a pair of laterally spaced cushioned mounds 50 and 52 (see FIGS. 2 and 3) to simulate a mother's breasts.

Figure 4:
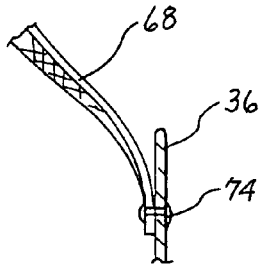
FIG. 4 is an enlarged, partial sectional view of taken through section line 4 of FIG. 2 and illustrating the attachment of a shoulder strap end to the infant support device.

In order to safely support infant 12 upon infant support device 10, securing mechanisms are provided. First, infant support device 10, in its preferred embodiment, includes a pair of infant panties 54 having a waist opening, bordered by a waist band 56 for encircling the infant's waist and having a pair of leg openings 58 and 60 for encircling the infant's legs. Panties 54 can be slipped over infant 12 before the infant is placed upon curved support 36. At least one waist strap, and preferably, a pair of waist straps 62 and 64 (see FIG. 1), are coupled to, and extend from, panties 54 for detachably securing panties 54 to curved support 36. It is preferred that waist band 56 and leg openings 58 and 60 of panties 54 are elasticized to snugly engage the infant's waist and legs. To further ensure that infant 12 does not inadvertently fall from curved support 36, a pair of diagonally arranged, shoulder straps 66 and 68 are preferably provided with detachable buckles 70 and 72, respectively, to retain infant 12 upon curved support 36. A short strap 69 extends from waistband 56 of panties 54 and includes end 71 that can be inserted into buckle 72 and releasably latched therein. As shown in FIG. 4, the upper portion of shoulder strap 68 may be secured to the side wall of curved support 36 by fastener 74.

Figure 6:
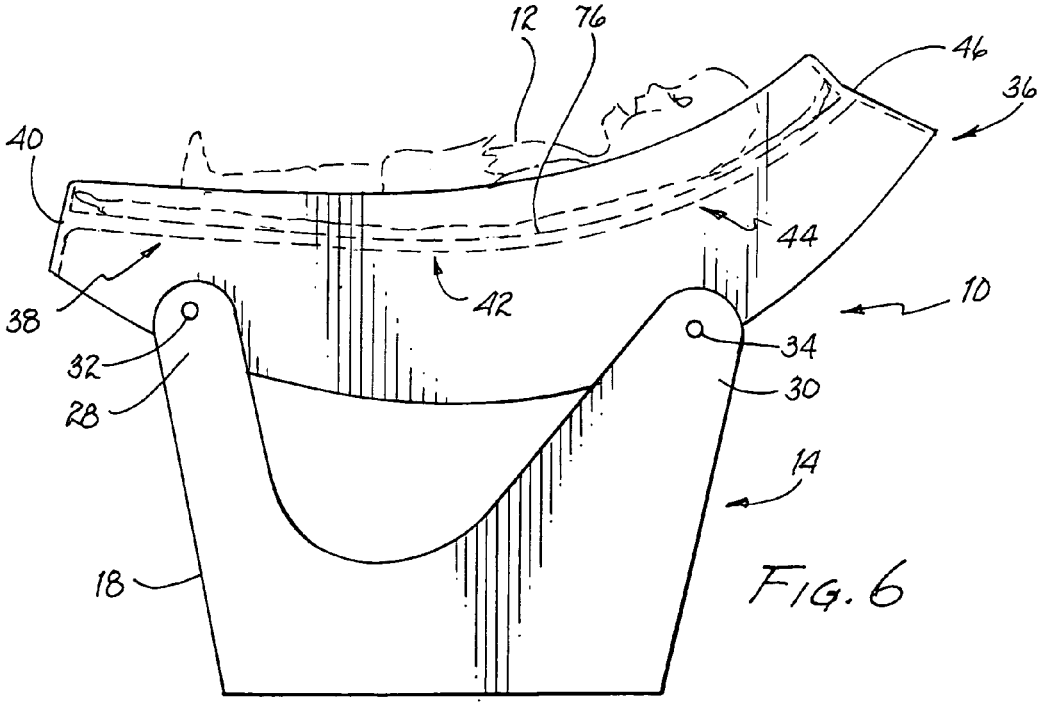
FIG. 6 is a side view of the infant support device and illustrating how the curved support may be inverted as the infant grows in size to resemble a more conventional infant carrier.

Referring to FIG. 6, the underside 76 of curved support 36 forms a generally concave surface. If desired, curved support 36 can be detached from base 14, flipped over, and re-attached to base 14 with underside 76 facing up. In this manner, curved support 36 may be used to support an infant, or older baby, on his or her back, in the general manner of a more conventional baby carrier.

Figure 7:
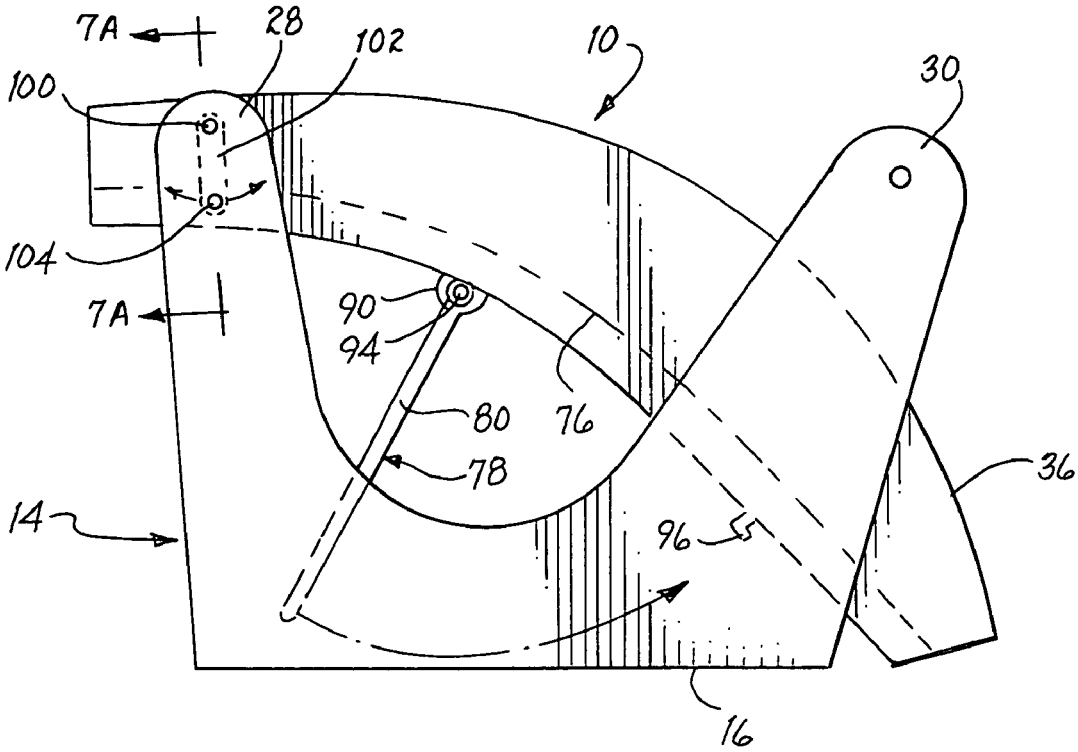
FIG. 7 is a side view of the infant support device partially detached from a rocking frame member and illustrating a retractable support leg.
Figure 8:
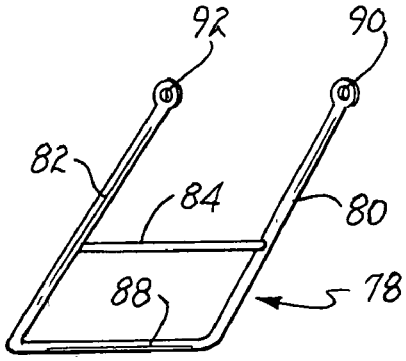
FIG. 8 is a perspective view of the retractable support leg shown in dashed outline in FIG. 7.

Turning to FIG. 7, infant support device 10 may include a frame member in the form of a retractable support leg 78 extending generally from the underside of curved support 36, preferably opposite head support and stomach support surfaces 38 and 42, respectively, for propping infant carrier 10 into an upright position when curved support 36 is detached from base 14. Support leg is shown in greater detail in FIG. 8 and may include two legs 80 and 82 coupled to each other in spaced relationship by cross members 84 and 88. Legs 80 and 82 preferably include an eyelet (90, 92) for pivotal attachment to mounting brackets provided on the under side of curved support 36. For example, as shown in FIG. 78, eyelet 90 of leg 80 is adapted to be pivotally connected to mounting bracket 94. A retainer 96 keeps leg 78 against the under side of curved support 36 until ready for use.

Figure 7A:
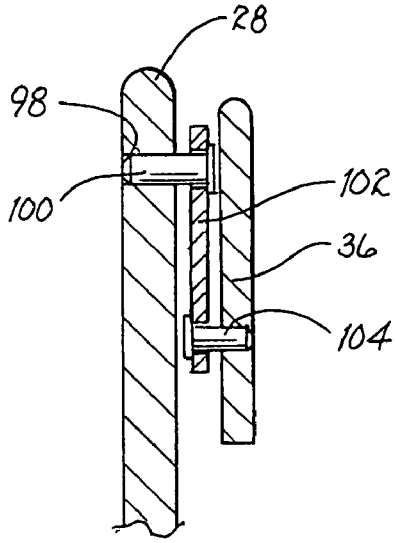
FIG. 7A is a partial enlarged sectional view, taken through section lines 7A-7A shown in FIG. 7, and illustrating a suspension linkage for allowing the curved support to be rocked upon a rocking frame member.

In FIGS. 1-3, curved support 36 is removably attached to base 14 in a fixed position, i.e without the ability to move or rock. In FIGS. 7 and 7A, an alternate embodiment is illustrated whereby curved support 36 is suspended from base 14 by a pivoting linkage for allowing curved support 36 to rock back and forth relative to base 14. In this alternate embodiment, upright peak 28 has an aperture 98 formed therein to receive axle 100. Suspended from axle 100 is an intermediate linkage 102, the lower end of which engages a second axle 104 extending from the side wall of curved support 36. While not shown in FIG. 7, a similar linkage may be provided near the tops of upright peaks 28', 30 and 30'. The above-described linkage allows curved support 36 to be movably suspended from the upright peaks of base 14 to rock curved support 36, and infant 12, back and forth.

Those skilled in the art will now appreciate that an infant sleep support device has been described which allows newborn infants, up to approximately three months old, to sleep in a more natural position upon their stomachs, simulating the position and feel of an infant in a burping position upon a caregiver's shoulder, with the infant's legs positioned lower than the infant's head. The infant's head is supported upon a generally horizontal surface while the infant's lower abdomen and legs are supported upon a downwardly-inclined surface. The contoured cushion of the preferred embodiment of the present invention closely simulates the position and feel of an infant lying face down upon a mother's chest. The infant can be comfortably supported upon such infant support device, while a fastening system reliably secures the infant thereto. The disclosed device may easily be converted to support an infant upon his or her back. Moreover, the disclosed infant support device can supported in either a fixed or rocking position.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. An infant support device for supporting an infant comprising in combination:

a. a semi-rigid curved support including:

i. a head support surface for supporting the head of the infant in a generally horizontal plane;

ii. a stomach support surface coupled to the head support surface for supporting the stomach of the infant, the stomach support surface extending at a slightly downward incline from the head support surface, the stomach support surface and the head support surface collectively forming a continuous curve for supporting the infant in a prone position;

b. a cushion disposed over the head support surface and over the stomach support surface;

c. securing means fastened to the curved support for extending generally about the infant's waist to secure the infant upon the curved support; and d. a frame member adapted to rest upon a horizontal base, the frame member being coupled to the curved support for supporting the curved support in a position wherein the cushioned head support surface extends generally horizontally.

2. The infant support device recited by claim 1 wherein the curved support further includes a leg support surface coupled to the stomach support surface and extending at a downward incline from the stomach support surface, and wherein the cushion extends over the leg support surface of the curved support.

3. The infant support device recited by claim 1 wherein the curved support is movingly supported by the frame member for allowing the curved support to move relative to the frame member, and for allowing rocking motion of the infant.

4. The infant support device recited by claim 1 wherein the curved support is removably attached to the frame member.

5. The infant support device recited by claim 4 wherein the curved support includes an underside opposite and below the head support surface and stomach support surface, and wherein the curved support is attached to the frame member in an inverted position, with the head support surface and stomach support surface generally facing downward, and with the underside generally facing upward, for supporting an infant on his or her back upon the underside of the curved support surface.

6. The infant support device recited by claim 1 wherein the curved support includes an underside opposite the head support and stomach support surfaces thereof, and wherein the frame member includes a support leg pivotally coupled to, and extending from, the underside of the curved support.

7. An infant support device for supporting an infant comprising in combination:

a. semi-rigid curved support including:

i. a head support surface for supporting the head of the infant in a generally horizontal plane;

ii. a stomach support surface coupled to the head support surface for supporting the stomach of the infant, the stomach support surface extending at a slightly downward incline from the head support surface;

b. a cushion disposed over the head support surface and over the stomach support surface wherein the portion of the cushion that covers the stomach support surface includes first and second spaced cushioned mounds to simulate a mother's breasts;

c. securing means fastened to the curved support for extending generally about the infant's waist to secure the infant upon the curved support; and d. a frame member adapted to rest upon a horizontal base, the frame member being coupled to the curved support for supporting the curved support in a position wherein the cushioned head support surface extends generally horizontally.

8. The infant support device recited by claim 7 wherein the curved support is movingly supported by the frame member for allowing the curved support to move relative to the frame member, and for allowing rocking motion of the infant.

9. The infant support device recited by claim 7 wherein the curved support is removably attached to the frame member.

10. The infant support device recited by claim 9 wherein the curved support includes an underside opposite and below the head support surface and stomach support surface, and wherein the curved support is attached to the frame member in an inverted position, with the head support surface and stomach support surface generally facing downward, and with the underside generally facing upward, for supporting an infant on his or her back upon the underside of the curved support surface.

11. The infant support device recited by claim 7 wherein the curved support includes an underside opposite the head support and stomach support surfaces thereof, and wherein the frame member includes a support leg pivotally coupled to, and extending from, the underside of the curved support.

12. An infant support device for supporting an infant comprising in combination:

a. a semi-rigid curved support including:

i. a head support surface for supporting the head of the infant in a generally horizontal plane;

ii. a stomach support surface coupled to the head support surface for supporting the stomach of the infant, the stomach support surface extending at a slightly downward incline from the head subvert surface;

b. a cushion disposed over the head support surface and over the stomach support surface;

c. securing means fastened to the curved support for extending generally about the infant's waist to secure the infant upon the curved support, wherein the securing means includes:

a. panties having a waist band for encircling the infant's waist, and having a pair of leg openings for encircling the infant's legs; and b. at least one strap coupled to the panties and coupled to the curved support for securing the panties to the curved support; and d. a frame member adapted to rest upon a horizontal base, the frame member being coupled to the curved support for supporting the curved support in a position wherein the cushioned head support surface extends generally horizontally.

13. The infant support device recited by claim 12 wherein the waist band and leg openings of the panties are elastic to snugly engage the infant's waist and legs.

14. The infant support device recited by claim 12 wherein the securing means includes first and second shoulder straps that extend over the shoulders of the infant.

15. The infant support device recited by claim 12 wherein the curved support is movingly supported by the frame member for allowing the curved support to move relative to the frame member, and for allowing rocking motion of the infant.

16. The infant support device recited by claim 12 wherein the curved support is removably attached to the frame member.

17. The infant support device recited by claim 16 wherein the curved support includes an underside opposite and below the head support surface and stomach support surface, and wherein the curved support is attached to the frame member in an inverted position, with the head support surface and stomach support surface generally facing downward, and with the underside generally facing upward, for supporting an infant on his or her back upon the underside of the curved support surface.

18. The infant support device recited by claim 12 wherein the curved support includes an underside opposite the head support and stomach support surfaces thereof, and wherein the frame member includes a support leg pivotally coupled to, and extending from, the underside of the curved support.

* * * * *